US007246064B1

(12) United States Patent
Thomas

(10) Patent No.: US 7,246,064 B1
(45) Date of Patent: Jul. 17, 2007

(54) SINGLE CONTROL MESSAGE DEVICE

(76) Inventor: Debbie L. Thomas, P.O. Box 1062, Pacific Grove, CA (US) 93950

( * ) Notice: Subject to any disclaimer, the term of this patent is extended or adjusted under 35 U.S.C. 154(b) by 913 days.

(21) Appl. No.: 10/410,367

(22) Filed: Apr. 8, 2003

(51) Int. Cl.
*G10L 21/00* (2006.01)

(52) U.S. Cl. ..... 704/272; 704/201; 434/156; 369/1

(58) Field of Classification Search ..... 704/272, 704/201; D14/160–169; 434/156; 369/1
See application file for complete search history.

(56) References Cited

U.S. PATENT DOCUMENTS

| | | | | |
|---|---|---|---|---|
| 4,067,005 | A | 1/1978 | Levy et al. | |
| 5,125,026 | A | 6/1992 | Holcombe | |
| 5,161,199 | A * | 11/1992 | David | 704/201 |
| 5,241,427 | A | 8/1993 | Lin | |
| 5,535,262 | A | 7/1996 | Kanzawa | |
| 5,615,380 | A * | 3/1997 | Hyatt | 345/520 |
| 5,867,793 | A | 2/1999 | Davis | |
| 5,898,392 | A * | 4/1999 | Bambini et al. | 340/996 |
| 5,903,869 | A | 5/1999 | Jacobson et al. | |
| D413,889 | S * | 9/1999 | Nakano | D14/167 |
| 6,310,940 | B1 | 10/2001 | Ratz | |
| 6,431,724 | B1 * | 8/2002 | Tedham et al. | 362/154 |
| 7,133,837 | B1 * | 11/2006 | Barnes, Jr. | 705/26 |
| 2002/0137012 | A1 * | 9/2002 | Hohl | 434/156 |
| 2004/0022137 | A1 * | 2/2004 | Campbell et al. | 369/1 |

* cited by examiner

*Primary Examiner*—Richemond Dorvil
*Assistant Examiner*—Qi Han
(74) *Attorney, Agent, or Firm*—Schmeiser, Olsen & Watts LLP

(57) ABSTRACT

A message device records and plays messages. In a first aspect, actuation is effected by way of a single control. The control generally corresponds to the whole cover. Relatedly, in a second aspect the device is extremely simple and promotes openness communication. The device can be placed or hung almost anywhere to facilitate message leaving and receiving in almost any group or organization. In one embodiment actuation is achieved by pressing on substantially any portion of the cover. In a second embodiment, a rocker configuration is implemented to actuate a record mode by pressing on one end of the cover and a play/listen mode by pressing on an opposite end. The device comprises a base, electrical components, a cover, and in some embodiments, a side wall.

23 Claims, 5 Drawing Sheets

SINGLE CONTROL MESSAGE DEVICE

BACKGROUND OF THE INVENTION

1. Technical Field

This invention generally relates to message recording devices, and more specifically to message recording devices that can easily be used by a large number of people having a broad range of message recording and receiving needs.

2. Background Art

Recording devices of the past include reel to reel tape players, cassette tape players, digital recording devices including CD write devices. These devices of the past include recording devices that are designed specific applications. For example, some telephone answering machines of the past include two cassettes and special buttons for skipping or saving messages. CD writers have a laser for "burning" in the recording. The recording devices that are designed for special applications are often part of a more complex and expensive system such as a computer or telephone. Some of the recording devices of the past have been designed as multipurpose recording devices. However, even the multipurpose devices have special buttons and features for actuating special functions or modes of operation. Even the simplest recording devices of the past are relatively complex and expensive.

Most of the devices of the past function as personal recording devices in which the owner or operator becomes familiar with the buttons, and controls the recording device for the duration of a particular application. Most of these devices requires some familiarizing with the various buttons for recording and playing. Furthermore, identifying or connecting the microphone before recording may be required. Often times the buttons are small or require extra effort to depress or move into a record mode. Occasionally, a user will accidentally place the recorder in a record mode and inadvertently record over something that was intended to be played. Important recorded information can thus inadvertently be lost. In any case special care must be taken to press the correct buttons in order to record or listen, in addition to worrying about the volume control, microphones, and rewind features.

There is a deficiency of simple devices for use by a large number of people for a broad range of purposes. The past devices are also inadequate in providing devices with a small number of controls that are easily manipulated for a small number of basic functions. The devices of the past do not adequately promote open communication via audio messages in a group or organization. The devices of the past are certainly deficient in promoting such communication in a simple and inexpensive way.

Additionally, the devices of the past are deficient in providing a wide variety of supports for supporting the devices in a wide variety of applications and positions.

DISCLOSURE OF THE INVENTION

The present invention overcomes many of the deficiencies of the past with a single control message device. The single control message device has a base forming a lower surface of the device. The device has an upper surface generally opposite to the lower surface. The upper surface includes a cover that is resiliently supported on the base and forms a major portion of the upper surface. The cover also forms a single control. The device further has electrical components supported on the base. The electrical components are wired or programmed for receiving an audible message, storing the message, and replaying the message in response to actuation of the electrical components via the single control. The single control message device also has at least one support for supporting the single control message device on a table, a wall, a hook, or other object.

In another aspect of the invention, the single control message device has a symbolic shape and an illumination that exudes a feeling of simplicity, warmth, and openness. In particular, device may include the form of a heart, a rectangle, a circle, an oval, a moon, a nose, an exclamation point, a book, or at least one written character.

In another aspect of the invention, the single control message device is one of a plurality of like devices. In this case, the cover is one of a plurality of like covers, and the electrical components are a first set of a plurality of like sets of electrical components. As such, the plurality of covers and the plurality of sets of electrical components form a respective plurality of single control message devices usable together. Likewise, the single control is a first of a respective plurality of single controls. Each control effects more than one function in a respective one of the devices. In this aspect of the invention, the plurality of devices may be connected together.

The support of the single control device may include any of a variety of securing or supporting mechanisms. These mechanisms may include, but are not limited to slip resistant supporting pads on an underside, two sided adhesive tape, hook and loop fasteners, magnets, and/or a ring and necklace connected to the device. An alternative supporting mechanism is a bag with a string for hanging the bag and the device.

In another aspect, the invention includes a method of using the single control message device. The method includes recording an audible message and automatically turning on a visual indicator by pressing the control a certain number of times in rapid succession to actuate a record mode. The message is recorded by annunciating the audible message after the record mode has been actuated. The message also includes listening to the message by pressing the control a certain number of times after the visual indicator has been turned on.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to audio message devices that are simple to use and well adapted for use by a large number of people with a broad range of message recording and message receiving needs. The devices of the present invention are also well adapted for use by a select number of people or a single person as well.

Figure 1:
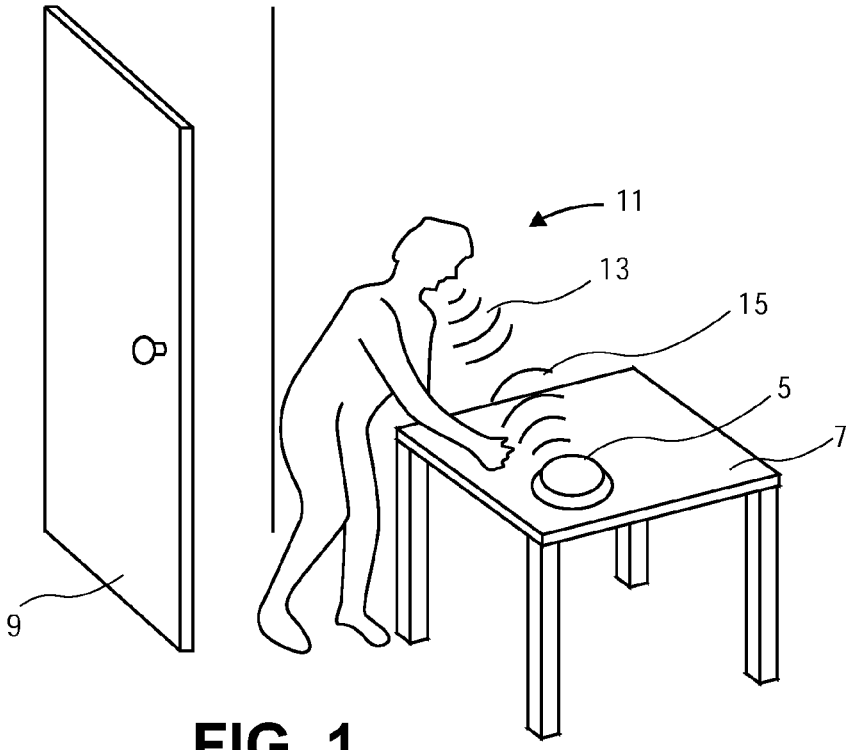
FIG. 1 is an exemplary perspective view of a first embodiment of a device of the present invention as it may be used.

In one application shown in FIG. 1, a single control message device 5 is conveniently placed on a table 7 near an entry door 9 so that a person 11 may easily record an audible message 13 by speaking, or listen to a replayed message 15 when leaving or returning through the door 9. As can be appreciated, the device 5 lends itself to easy communication by audible messaging and facilitates sharing of information and keeping the communication open, especially for groups that have different schedules for coming and going.

Another application is that of leaving a recorded set of instructions. For this application, the device 5 could be combined with a piece of heavy machinery or an exercise machine. Any tool or piece of equipment needs a set of instructions and/or cautions could greatly benefit from combination with the device 5. Leaving instructions on the device 5 is not limited to combination with equipment. For example, the device could be used for leaving instructions for a baby sitter, house sitter, employees, a subsequent shift of workers, children in a family and others.

Figure 2:
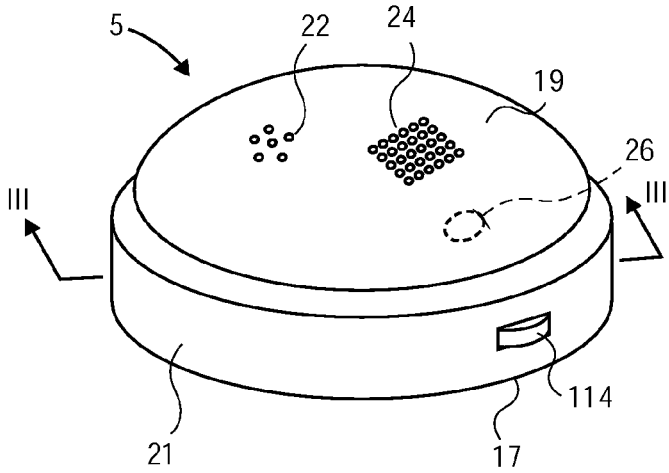
FIG. 2 is a perspective view of the device of FIG. 1.

In a first embodiment shown in FIG. 2, the single control message device 5 has a base 17, a cover 19, and a side wall 21. The cover has a set of microphone holes 22 for receiving audio messages 13, and a set of speaker holes 24 for permitting the recorded message to be transmitted through the cover 19. The whole cover 19 can be translucent or may have one or more portions 26 that are transparent or translucent for passing light through the cover 19.

Figure 3:
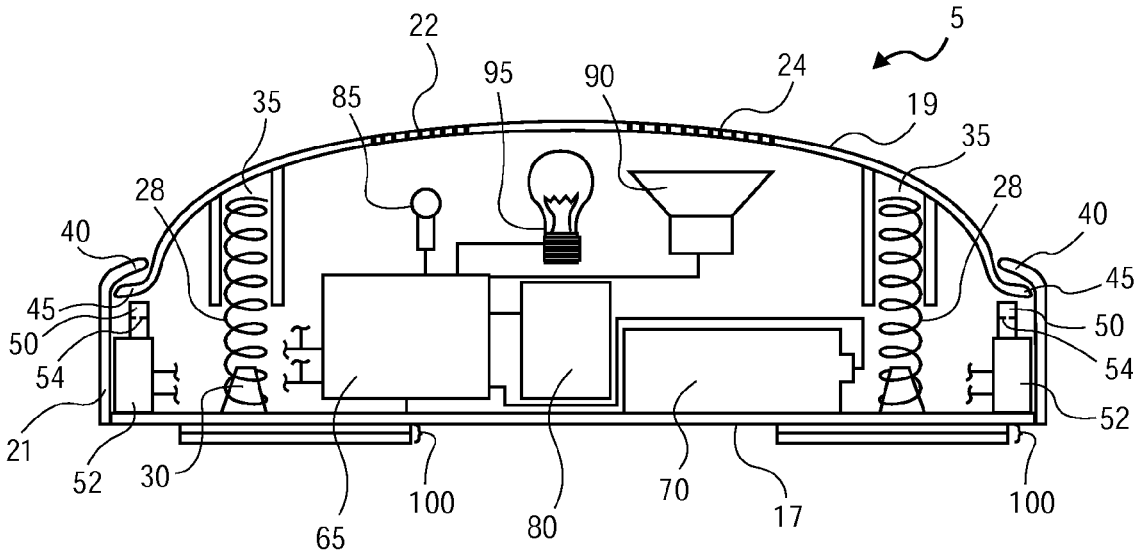
FIG. 3 is a sectional side view taken along lines III-III of FIG. 2 and showing typical internal components of the device.

FIG. 3 is a cross sectional view taken along lines III-III of FIG. 2 and shows an example of how the single control message device 5 may be constructed. FIG. 3 shows the base 17, which is adapted for resting on a flat surface such as the table 7 of FIG. 1. The base 17 functions as a support for the rest of the components of the device 5. In the embodiment of FIG. 3, the cover 19 is resiliently supported on the base by springs 28. To maintain the springs in their proper position on the base 17, spring studs 30 are provided on the base 17 and protrude upwardly out of a plane of the base 17. Receiver shafts 35 are located on an underside of the cover 19 in positions that correspond with the spring studs so that the springs are also maintained in their proper positions on the underside of the cover during and after assembly. As can be appreciated from FIG. 3, the springs 28 normally urge the cover 19 away from the base 17. To hold the assembly together, the side wall 21 is connected to the base 17 and has an inwardly extending lip 40. The side wall 21 may be attached to the base by a snap fit connection, screws, or glue. The inwardly extending lip 40 extends over and abuts a ledge 45 on a periphery of the cover 19. As such, the lip 40 holds the cover in place together with the rest of the device components, and causes the springs to be slightly compressed with the cover in its fully up position as shown in FIG. 3.

In the fully up position of FIG. 3, switch buttons 50 are not depressed and the switches 52 are open. When the cover is pressed, the switch button is depressed to a position 54 and the switches are closed. When the cover 19 is released, the cover 19 springs back into its fully up position. The switch buttons also spring back into a non-depressed position under the action of their own springs (not shown). In this way the switches are closed temporarily by pressing and releasing or tapping the cover 19 of the single control device 5. Thus, the cover 19 acts as a single control for the device 5 and controls electrical circuitry 55 that is enclosed in the device between the base 17 and the cover 19.

Figure 4:
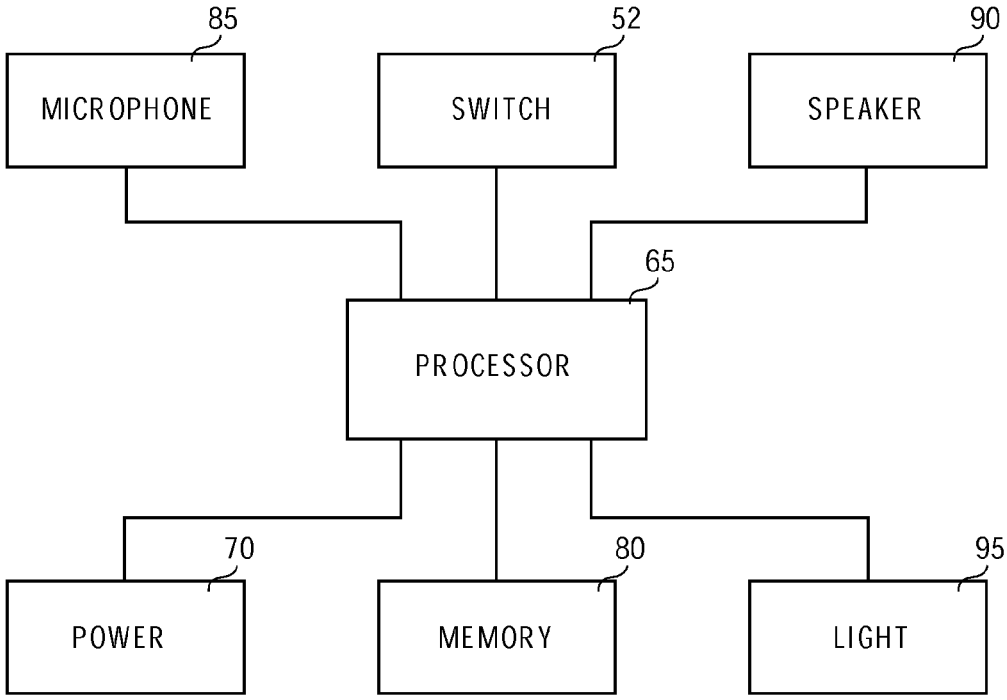
FIG. 4 is a schematic diagram showing the typical electrical components of any of the embodiments of the device of the present invention.

As shown in FIGS. 3 and 4, the electrical circuitry has a variety of components each provided for a particular function. Critical to the functionality of the device is a processor 65 that takes input from the switches 52 and gives output to the other components as set forth below. Of course, the electrical components including the processor must be connected to and powered by a power source 70. In FIG. 3, the power source 70 is depicted as a battery. However, the power source could be provided by a battery source, a wall plug source, or a combination of such sources as is well known in the art. Access to the batteries can be provided through a door or opening on the base 17 or side wall 21. Access through the side wall 21 is preferred when the device is to be mounted permanently on a wall or table, for example.

Memory 80 is also necessary at least for recording the audible message 13. The memory 80 is connected to the processor 65 and receives an output therefrom. A microphone 85 receives the audible message 13 and inputs a representative signal to the processor and/or memory. A speaker 90 receives a signal for the message 15 to be played as it is output by the processor. One or more lights 95 is turned on at specific times during use of the device in accordance with an output from the processor. Alternatively, the device can be made without a light 95. The specifics of how the various components interact can be varied without departing from the spirit and scope of the invention. The components themselves can also be varied qualitatively. For example, the processor can be implemented with an electronic chip, a programmable electronic chip, discrete components such as resistors, capacitors, transistors, and the like, or any combination of these. The programmable chip can also include or be associated with an EPROM or other programmable device that is programmed with software. Preferably the programmable device would comprise non-volatile memory. Appropriate selection of the specific components for the device and their configuration is considered to be within the capabilities of one of ordinary skill in the art. Additional examples of the functions of the components are further set forth in the description below.

As set forth above, the light 95 can be one of a plurality of lights provided in the device 5. The plurality of lights 95 can include a variety of colors for indicating different modes of operation, for example. The lights themselves can be regular filament type lights or light emitting diodes (LEDs). One or more of the whole cover 19, side wall 21, and base 17 can be translucent to emit light from large portions of the device. Alternatively, selected areas 26 of the cover 19 or side wall 21 can be made translucent to emit light only in those selected areas 26. The light or lights 95 can also be made to blink or shine constantly.

In order to actuate the device it is contemplated that the processor would be configured to respond to specific numbers of taps in rapid succession. For example, to place the device in a record mode may required two taps, after which an audible message may be annunciated. The processor can be configured to automatically stop recording when the audible sound ceases. Alternatively, the recording mode could be manually stopped by tapping twice in rapid succession again for a toggle effect of turning the record mode on and off. One tap replays the last recorded message. Three taps deletes the message. In this way a user can replay the last recorded message as many times as he or she wishes until the message is deleted. In fact, the message will be immediately replayed even if the cover is tapped once in the middle of the message.

Alternatively, the processor could be configured to automatically shift the mode to record after a message has been played, and automatically shift the mode to play after a message has been recorded. This configuration would allow for single taps to actuate each of the recording and playing functions. However, it would not provide the function of replaying a message more than once or deleting a message other than by recording over it. Hence, in order to add these functions, this configuration could be modified to include the replay and delete functions by two taps and three taps respectively.

The processor preferably has timing mechanisms that determine whether the taps are received in "rapid" succession. For example, in order to be perceived as a tap, the control or cover 19 must be pressed and released within the range from 0 to 2 seconds after pressing. Two taps must be completed in the range from 0 to 5 seconds. Three taps must be completed within the range from 0 to 7.5 seconds, and so forth.

The instructions for using the device 5 having a particular processor configuration can be included with the device or imprinted in the cover 19 or the base 17 in a few simple lines of text for easy access. However, the use of the device has the advantage of being almost intuitive. Even without the instructions a user can most likely figure out how to record and listen to messages by trial and error within a few attempts. This is, in large measure, because there is only one control, and there are only a few ways that a person can effectively manipulate the single control of the cover 19.

The light(s) 95 can be turned on and off under processor control to indicate a current mode. For example, a first light 95 could be turned on when a recording of a message begins or ends. This first light 95 could be constant or blinking and may have a selected color to indicate that a message has been recorded and is ready to be played. Once the message has been accessed or played, a second light 95 could be turned on and the first light 95 turned off. The second light 95 could have a distinct color and could be blinking or constant for indicating that an old message is on the device or that the device is ready for recording. A third light 95 of a third color distinct from the first and second colors could be turned on specifically for indicating that the device is ready for recording, such as when a message has been deleted or once the appropriate number of taps have been made to place the device in the record mode.

While the lights 95 are useful as indicator lights, they may alternatively or additionally be beneficial for illuminating a region near the device or even for dimly illuminating a room. As an indicator, providing the first light 95 as a blinking light has the advantage of calling a person's attention and invoking a sense of urgency to listen to the message that has been left. On the other hand, blinking lights are not normally preferred for illumination and may indeed be annoying to a person in the room. As such, a combination of a blinking light for a new message and constant lights for the other modes may be a preferred configuration. The size and power of lights 95 may be selected based on the power source to be used and the amount of illumination desired.

Preferably, the device will not have any light illuminated prior to actuation. Tapping the device twice in rapid succession then turns on a first light 95 such as a green LED in a small area 26 of the cover 19, indicating that the device 5 is ready to record an audible message 13. Once the message has been recorded the green LED is automatically turned off and a warm colored illuminating second light 95 is turned on to indicate that a new message has been recorded and is waiting to be retrieved. The second light 95 can be turned off by deleting the message with three taps. The memory 80 can be a non-volatile memory so that if power is lost due to a lengthy draw from the lights, the message is not permanently lost and may be retrieved once power is restored. With the processor and lights configured in this way, the device can also be used specifically as an illumination device. In order to turn the light on, a user can simply tap twice to record and then say anything, such as "light on" to turn on the illuminating second light 95. In this way a battery powered version of the device 5 can function as an emergency backup light when the power goes out in an office or home. This form of an emergency light has the advantage of avoiding the use of candles or other dangerous incendiary devices. Furthermore, the device can be used to record messages during an emergency.

Alternatively, when the device 5 is configured with illuminating light(s), it can be used for mood lighting. As such, a plurality of the devices 5 of different sizes and colors can replace candles or other low lighting for a romantic effect. In this regard, the devices can be used in a private setting, in a large group setting, or in public. For example, the devices 5 can be used in weddings as color coordinated and/or lighted centerpieces. Friends of the bride and groom can leave personalized messages recorded on the devices.

There are advantages to leaving an audible message in a recognizable voice. When such a message expresses love or friendship in a familiar voice, it promotes positive feelings of confidence and reassurance. The devices of the present invention can be used to leave personalized messages of all sorts and on any of a variety of occasions. Leaving messages of love and reassurance on the device 5 can be especially beneficial to children or pets.

For applications having the potential of requiring more than one message on the device, it would be important for the device to be capable of storing and replaying more than one message. Preferably, this could be done by recording and storing the messages digitally in the memory 80. In this case, the processor 65 could be configured to mark the beginning of the first message. Then four taps could target the mark at the beginning of the sequence of messages, and a single tap would then begin playing the messages from the beginning of the sequence. That is, four taps provides an actuation analogous to a rewind feature. Subsequent single taps could step through the messages sequentially so that a user can skip to the beginning by four taps and then incrementally skip through the messages in the order they were recorded by single taps. Alternatively, the plurality of messages could be recorded on a recording medium such as a mini-cassette tape. The recording medium were a removable recording medium the messages could be physically removed from the device 5 for replay in a separate device. However, in most applications, it is only necessary for the device to be capable of storing a single message.

Figure 5:
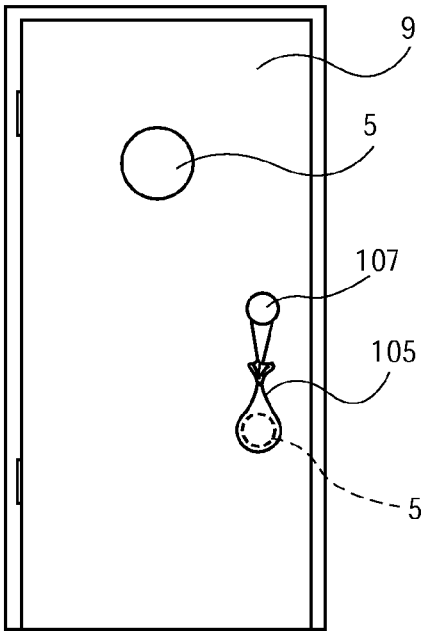
FIG. 5 is an exemplary top view of the device of FIG. 1 supported in two different ways.

Another aspect of the present invention is the potential for use in a wide variety of application and environments. Related to this is the many ways in which the device 5 can be supported. That is, while the device 5 can be supported on a table as depicted in FIG. 1, it can also be mounted on any non-horizontal surface. FIG. 5 shows the device 5 mounted on an upper portion of a door 9. This may be achieved by a two-sided sticky tape or hook and loop fasteners as shown at 100 on the base 17 in FIG. 3. The depiction at 100 shows two layers. In one case, the first layer is adhered to the base 17 and has a sticky lower surface. In this case, the second layer is a protective paper for protecting the sticky lower surface of the first layer. In another case, the first layer is adhered to the underside of the base and comprises one of hooks and loops thereon extending away from the base. In this case, the second layer has the other of the hooks and loops thereon for mating with the first layer. Further alternatively, elements 100 can simply be non-skid pads for supporting the device 5 on a horizontal surface.

Figure 6:
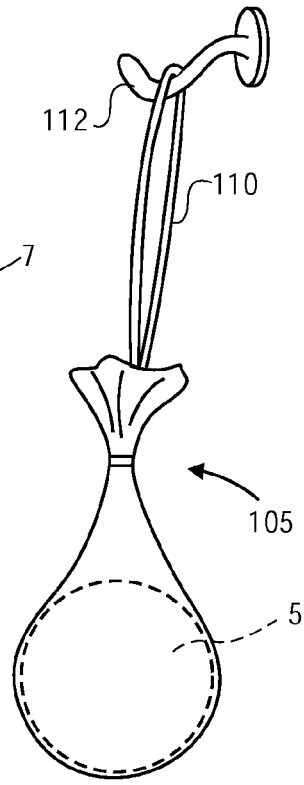
FIG. 6 is an exemplary view of a bag support for the device similar to the one shown in FIG. 5.

A further alternative for supporting the device 5 is the bag support 105 shown hanging from a door knob 107 in FIG. 5. As can be appreciated from FIGS. 5 and 6, the bag support 105 can comprise a bag of cloth or other flexible material and a pull sting 110 or the like for hanging the bag and the device on a hook 112 or a knob 107. The bag may be constructed of a velvet, beaded, or other aesthetic material. Alternatively, the bag may be made all or in part of a lace material. The lace could be of a dense or fine weave, and could be of any of a variety of colors. As such, the bag can selectively provide light radiation filtering characteristics for blocking and/or filtering at least a portion of the radiation from a light 95 of the device 5. A similar effect could be achieved by colored transparent or translucent bags formed of plastic or some other material.

Figure 7:
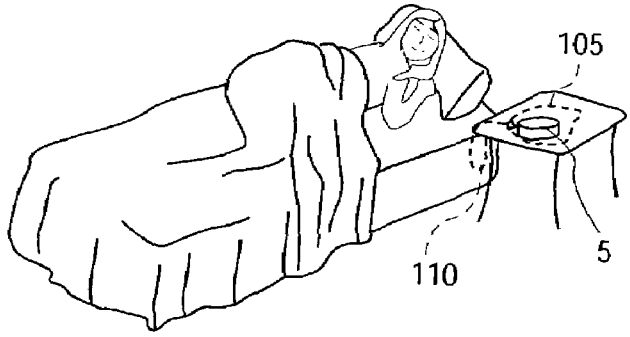
FIG. 7 is an exemplary perspective view depicting an application for any of the embodiments of the present invention.

The device 5 can also be used as an aid for dream therapy. Therapist often have difficulty getting their clients to keep a journal. This can be even more challenging when the client is asked to write when half asleep. So the device 5 provides an attractive alternative to writing the dreams by enabling the user to record a spoken message without having to get up, use a pencil and paper, or turn on a light as depicted in FIG. 7. Advantageously, a plurality of bag supports 105 having different light filtering and blocking characteristics could be provided with the device so that the user may select the support that best meets the needs of a particular application. For example, when the device is to be used at night for recording dreams, a bag support 105 that blocks most or all of the light would prevent unpleasant light radiation from disturbing those sleeping. At the same time, the bag support 105 can aid the user in finding the device 5—in the dark since it can support the device in a predetermined location. Alternative to blocking light with a bag, a dimmer switch 114 connected to the light could be provided as shown in FIG. 2. In this application of using the device 5 in the dark, another advantage of the device 5 becomes even more significant. That is, to operate the single control of the present invention, no light is needed since substantially the whole cover 19 is the control.

For example, the user awakes in the middle of the night and wishes to record a fleeting thought or dream. The device 5 can be in a predetermined position such as hanging on a bed knob or a hook within reach, or under the user's pillow. The user thus simply reaches for the device, identifies the cover by feel, taps the ordinate number of times to induce the record mode, and speaks the thought or dream. The processor can be configured to automatically stop recording a certain number of seconds after audible sounds stops, or to require a specific input by tapping.

Another use for the device 5 is for recording audible evidence of something that happened while someone is sleeping, for example. Although not limited to night time applications, a humorous application could be that of recording a spouse's snoring as evidence that he or she actually does snore. An advantage in this application is that the record mode can be actuated without awakening the sleeping person. With the present invention, a user does not need to turn on a light or move much to actuate the record function in the middle of the night.

Figure 8:
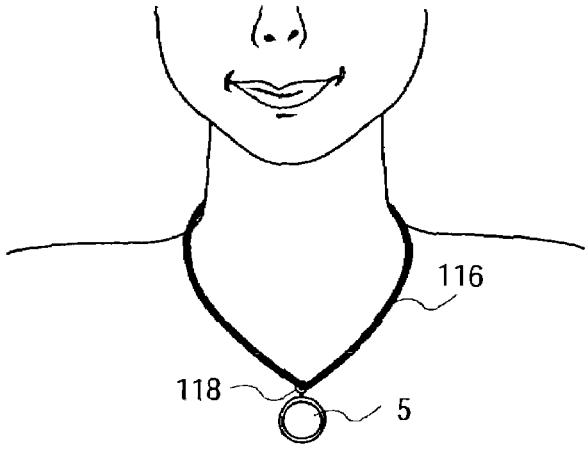
FIG. 8 is a top view of a second embodiment of the device of the invention depicting a further alternative support for facilitating wearing the device.

A further alternative support is depicted in FIG. 8. Here the device 5 is shown supported on a necklace 116 and hanging around a person's neck. To this end, a ring 118 is connected to the device for receiving the necklace 116. In this application, the device 5 is made to be smaller than in the previous illustrations. It is to be understood that the device 5 can be made of any size or configuration as can be appreciated by the further description below. The size of the device 5 is only constrained by the size of the components used in its construction. However, an important goal and advantage of the invention is that the device 5 is usually small and generally portable.

When the device is configured to record only a single message at a time, an old message may be recorded over each time a new message is created. In this configuration, it is important that the processor place markers at the beginning and end of the stored message as is known in the art. In this way, only the last saved message is replayed. For most purposes with the present invention, the need to leave more than one message can be satisfied by simply using additional devices.

Figure 9:
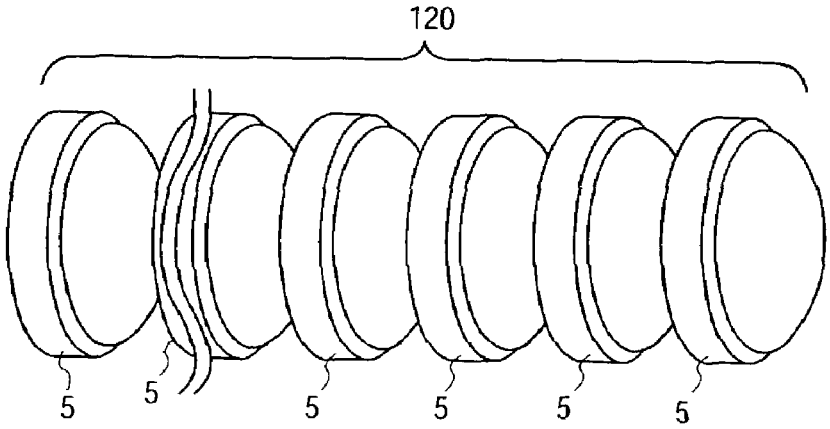
FIG. 9 is a side view of a set of devices of the first embodiment.

In fact, in one aspect, the device 5 is one of a plurality of devices 5 useable together as shown in FIG. 9. As such, the devices 5 form a set 120 that can be used in a game in which the devices have messages recorded thereon including riddles or clues for finding a subsequent device in the set.

The set of devices 120 is also useful in other applications such as for simply leaving more than one message. The devices 5 of set 120 could be color coded or have individual names for identifying members of a group or family. In this way, messages for a particular individual can be recorded on that person's device 5. Alternatively, a device or set of devices 120 can replace sticky notes that many people use to remind themselves and others of things that need to be done.

While the invention has been described with regard to a particular embodiment and a variety of applications above, there are additional contemplated embodiments that are equally useful in the above applications and which have may have additional advantages in other applications. Any or all of the features described above may be incorporated into any of the embodiments described below. These additional embodiments are not intended to limit the scope of the invention, but are exemplary as is the first embodiment set forth above. As such, the invention is to be limited only by the appended claims.

Figure 10A:
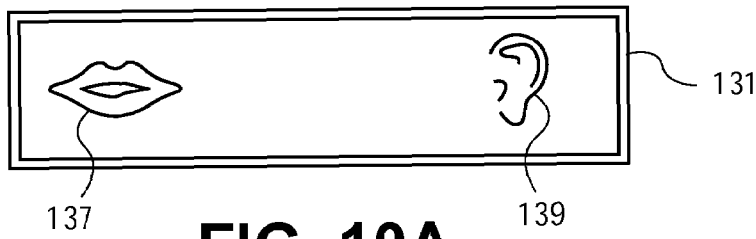
FIG. 10A is a top view of a third embodiment of a device of the present invention.

FIGS. 10A and 101B show an alternative single control message device 125 having a base 127, a cover 129, and a side wall 131. The message device 125 can have substantially the same electrical components as those shown and described for the embodiment of FIGS. 1-9 above. However, device 125 implements a rocker type cover 129 for input switching. The cover 129 is supported on the base 127 by a fulcrum 133 and a rocker pivot element 135. An upper surface of the cover 129 has symbols 137 and 139 for "talk" and "listen" respectively at opposite ends of the cover 129. Symbols 137 and 139 could be in the form of words, characters, or braille representing "talk" and "listen". Although not required, the cover 129 may be elongate to accentuate the function of the single control provided by the cover 129 with a "teeter-totter" motion about the pivot element 135. The side wall 131 may have lips 141 and the cover may have ledges 143 analogous to those of the embodiment of FIGS. 1-9. However, a gap 145 will be necessary to accommodate movement of one of the ledges 143 in an upward arc when the other ledge 143 is moved downward to depress a switch button 50. As can be appreciated, the configuration of the electrical components must be modified as compared to the previously described embodiment. For example, the processor must be configured to accommodate the input from the separate switches to place the device in a record or a play mode. Since the lips 141 do not necessarily stop upward motion of the ledges 143, this embodiment can also be formed without the side wall 131.

Figure 11:
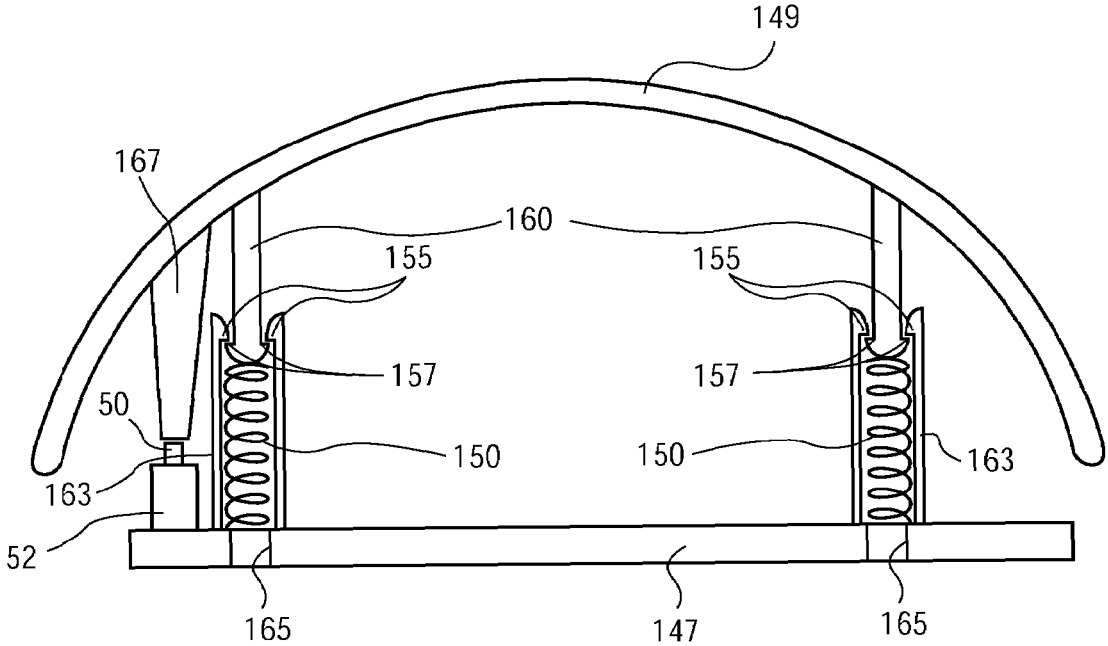
FIG. 11 is a sectional side view of a fourth embodiment of a device of the present invention.

FIG. 11 shows a third embodiment substantially similar to the first embodiment of FIGS. 1-9, but without the side wall 21. In this embodiment, a base 147 is provided. A cover 149 is resiliently supported on the base 147 by springs 150. To provide some of the function of the previously described side wall 21, guide lips 155 and guide ledges 157 have been incorporated into guide studs 160 and guide shafts 163. During assembly, the guide studs 160 are inserted into the guide shafts 163 in a sliding relation. The guide ledges 157 are snap fitted into the guide shaft 163 as shown. As can be appreciated, the ledges 157 can be released by inserting a screw driver or other elongate tool through openings 165 and forcing one or both lips outwardly to allow the ledges 157 to exit the guide shaft. In an assembled state, the springs 150 normally urge the cover 149 in an up position. In order to actuate the device the cover is pressed and released or tapped as previously described. In this embodiment, a depressor stud 167 engages and presses a switch button 50 during pressing or tapping of the cover 149 substantially analogously to the embodiment of FIGS. 1-9 as described above. The cover can be one of a plurality of interchangeable covers having a variety of colors, light filtering characteristics, and textures. The cover 149 can be selected from among the plurality of covers 149 and simply snapped on to replace a removed cover 149. The snapping on and off capability can be varied by the resiliency and angle of abutting lips 155 and ledges 157 to provide a desired level of ease in removing and replacing the cover 149.

Figure 10B:
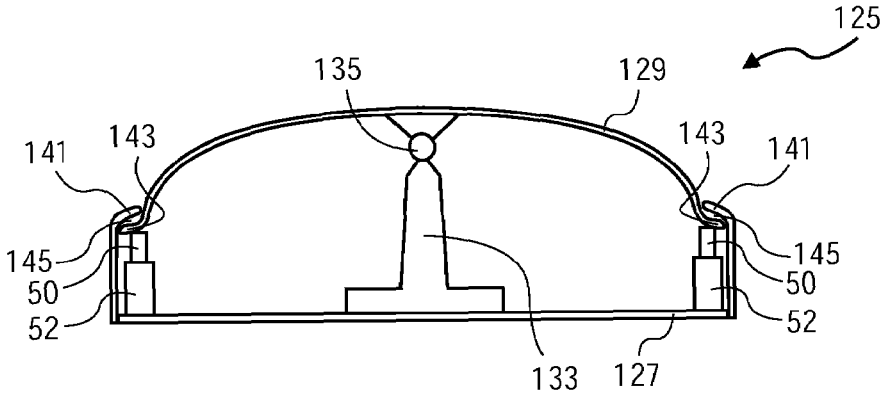
FIG. 10B is a sectional side view of the embodiment of FIG. 10A.

FIGS. 12A-12G depict several configurations 170, 175, 180, 185, 190, 195, 200, and 205 for the single control message device of the present invention. Each configuration can incorporate any of the three embodiments described above. Some of the configurations are better suited for certain applications. For example, the heart configuration 175 of FIG. 12B would be especially well suited for wearing on a necklace 116 around the neck. The elongate form of the exclamation mark configuration 195 of FIG. 12F lends itself to the rocking pivot embodiment of FIGS. 10A and 10B.

Figure 12A:
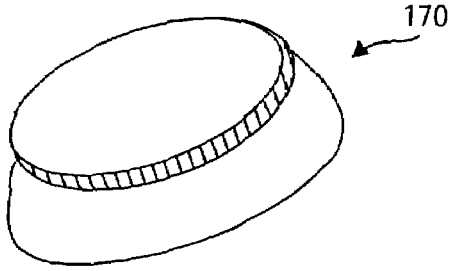
FIGS. 12A-12H are top or perspective view of several additional embodiments of the present invention.
Figure 12B:
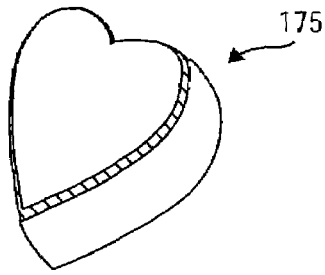
Figure 12C:
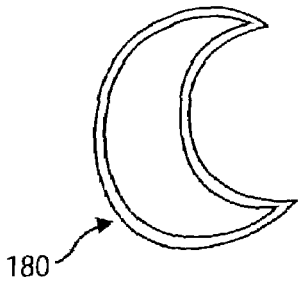
Figure 12D:
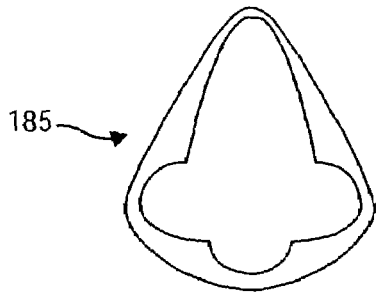
Figure 12E:
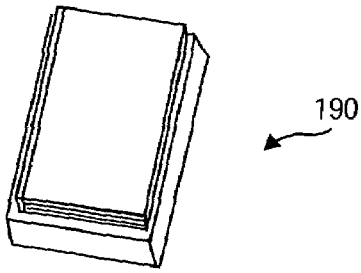
Figure 12F:
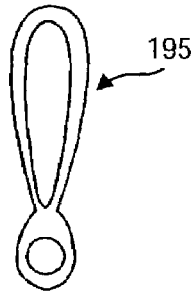
Figure 12G:
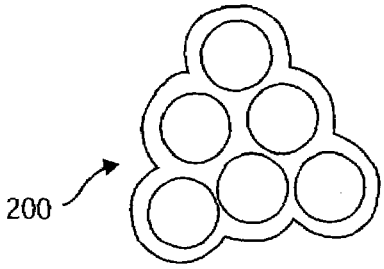
Figure 12H:
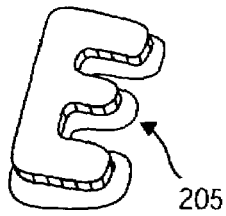

Some applications call for special configurations for the devices that are aesthetic and add a positive feeling to the use of the devices. For example, Device 170 of FIG. 12A is oval and therefore has a more elongate configuration which may fit a user's decorating scheme or preference better. Device 175 of FIG. 12B provides a romantic feeling to users and could effectively function to provide mood lighting as discussed above. Devices 180 and 185 are particularly well suited to night time use and symbolize the night time or snoring, respectively. Devices 190 and 195 are particularly representative of authors, musicians, or other creative individuals and provides such individuals with an easy way to record their innovative thoughts and ideas. Device 200 of FIG. 12G is an embodiment with several devices supported on a single base for conveniently providing the devices as a single unit. The several devices of the embodiment of FIG. 12G can be color coded or otherwise labeled for categories of messages or for particular users similar to the set 120 described above with regard to FIG. 9. Device 205 of FIG. 12H depicts a device formed as a letter. Device 205 could actually take the form of any letter or symbol. In particular, it would be advantageous to provide the device 205 as one or more of a person's initials to identify the device 205 with a particular user. This configuration provides the positive feeling of personal recognition that is important in any group. Similarly, the device could present the initials of a particular school or other organization. This would have the effect of promoting a feeling of team spirit or of belonging to a group.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A single control message device, comprising:

a base providing a major portion of a lower surface of the device;

an upper surface generally opposite to the lower surface;

a cover resiliently supported on the base, said cover forming a single control; and electrical components supported on the base;

wherein substantially the entire upper surface is formed by the cover, and wherein the electrical components are wired or programmed for:

receiving an audible message, storing the message, and replaying the message in response to actuation of the electrical components via the single control.

2. The single control message device of claim 1, further comprising:

a side wall connected to the base and extending upwardly therefrom with a lip extending inwardly along a top edge of the side wall; and at least one spring resiliently supporting the cover on the base and urging the cover away from the base, wherein:

the cover has a ledge extending outwardly from a lower extremity of the cover; and the ledge of the cover extends under the lip of the side wall and is urged into engagement therewith by the spring such that the cover is held in a non-depressed state by the lip of the side wall.

3. The single control message device of claim 1, wherein the electrical components further comprise:

a processor; and a switch;

wherein the processor has circuitry or software configured to effect a message record function when the single control turns the switch on and off twice in rapid succession.

4. The single control message device of claim 1, wherein the electrical components further comprise:

a processor; and a switch;

wherein the processor has circuitry or software configured to effect a message play function when the single control turns the switch on and off once in rapid succession.

5. The single control message device of claim 4, wherein:

the electrical components further comprise a light; and the processor turns on the light when a message is recorded.

6. The single control message device of claim 5, wherein the electrical components further comprise a dimmer switch.

7. The single control message device of claim 5, wherein:

the light is one of a plurality of lights having different colors; and each color represents a different mode of operation.

8. The single control message device of claim 1, wherein the electrical components further comprise:

a processor; and a switch;

wherein the processor has circuitry or software configured to effect a message delete function when the single control turns the switch on and off three times in rapid succession.

9. The single control message device of claim 1, further comprising a symbolic shape and an illumination.

10. The single control message device of claim 9, wherein the shape comprises one of a heart, a rectangle, a circle, an oval, a moon, a nose, an exclamation point, a book, or a written character.

11. The single control message device of claim 9, wherein the shape is elongate with symbols for "talk" and "listen" displayed at opposite elongate ends of the cover.

12. The single control message device of claim 9, wherein:

the electrical components further comprise a light;

the cover has a translucent portion; and either a bulb of the light or the translucent portion filters radiation from the light so that the illumination emits substantially warm or bright colors.

13. The single control message device of claim 1, further comprising a support that enables the single control message device to be attached to an object or worn by a user.

14. The single control message device of claim 13, wherein the object is one of a table, a wall and a hook.

15. A set of message devices comprising a plurality of single control message devices wherein each of the single control message devices comprises:

a lower surface;

an upper surface generally opposite to the lower surface;

a cover resiliently supported on the lower surface, said cover forming a single control; and electrical components supported on the lower surface, wherein substantially the entire upper surface is formed by the cover, wherein the electrical components are wired or programmed for:

receiving an audible message, storing the message, and replaying the message in response to actuation of the electrical components via the single control, and wherein each of the single control message devices has a unique identifier.

16. The set of message devices of claim 15, wherein the unique identifier is at least one of a color and a name.

17. The set of message devices of claim 15, wherein a single base supports all of the single control message devices to form a composite apparatus of all the single control message devices.

18. A single control message device and a support therefor, comprising:

a base providing a major portion of a lower surface of the device;

an upper surface generally opposite to the lower surface;

a cover resiliently supported on the base, said cover forming a single control; and electrical components supported on the base;

wherein substantially the entire upper surface is formed by the cover, wherein the electrical components are wired or programmed for:

receiving an audible message, storing the message, and replaying the message in response to actuation of the electrical components via the single control; and wherein the support enables the single control message device to be attached to an object or worn by a user.

19. The single control message device and support therefor of claim 18, wherein the support comprises one of a piece of two sided adhesive tape, a hook and loop fastener, a magnet, or a ring and necklace connected to the device.

20. The single control message device and support therefor of claim 18, wherein:

the support comprises a bag receiving the device; and the bag has a string for hanging the bag and the device.

21. The single control message device and support therefor of claim 20, wherein:

the electrical components further comprise a light; and the bag comprises lace or a translucent portion for blocking or filtering radiation from the light.

22. The single control message device and support therefor of claim 21, wherein the bag is one of a plurality of bags having a variety of respective radiation blocking and filtering properties.

23. The single control message device and support therefor of claim 18, wherein the object is one of a table, a wall and a hook.

* * * * *